United States Patent [19]

Schroeder

[11] Patent Number: 4,516,275

[45] Date of Patent: May 14, 1985

[54] GARMENT SUSPENSION WAISTBAND

[76] Inventor: Warren C. Schroeder, 2400 Virginia Ave., NW., C-603, Washington, D.C. 20037

[21] Appl. No.: 320,603

[22] Filed: Nov. 12, 1981

[51] Int. Cl.[3] ..... A41F 19/00

[52] U.S. Cl. ..... 2/308; 2/311; 2/312

[58] Field of Search ..... 2/308, 311, 312, 323, 2/322, 325, 338, 220, 221, 236, 237

[56] References Cited

U.S. PATENT DOCUMENTS

| | | | |
|---|---|---|---|
| 694,390 | 3/1902 | Krowthal | 2/308 |
| 709,823 | 9/1902 | Mehlfeld | 2/312 |
| 936,787 | 10/1909 | Levin | 2/312 |
| 1,147,225 | 7/1915 | Feldman | 2/312 |
| 1,285,325 | 11/1918 | Nelson | 2/312 |
| 1,331,457 | 2/1920 | Elliott | 2/221 |
| 1,506,255 | 8/1924 | Rosenstein | 2/236 |
| 1,584,765 | 5/1926 | Gillette | 2/236 |
| 1,597,734 | 4/1922 | Sousa | 2/308 |
| 1,948,251 | 11/1931 | Andrews | 2/312 |
| 2,223,621 | 12/1940 | Knappenberger | 2/308 |
| 2,615,171 | 10/1952 | Borowick | 2/312 X |
| 3,789,431 | 2/1974 | Rand | 2/236 |

FOREIGN PATENT DOCUMENTS

| | | | |
|---|---|---|---|
| 886113 | 1/1962 | United Kingdom | 2/221 |

*Primary Examiner*—Werner H. Schroeder
*Assistant Examiner*—Mary A. Ellis

[57] ABSTRACT

An inside garment waistband belt loop arrangement whereby the belt loops are secured at the bottom on the inside garment waistband and free to float inward at the upper loop end permitting a belt inserted therein to grip around individual's body waist free of gathering garment waistband.

2 Claims, 4 Drawing Figures

GARMENT SUSPENSION WAISTBAND

BACKGROUND OF THE INVENTION

The invention applies to a garment waistband, its attachments and flexibility to meet a varing waist measurement of the wearing occupant.

An individual's waistband measurement is not constant. It basically falls into four different measurement length classifications: standing, before eating; standing, after eating; sitting, before eating and sitting after eating. In addition there is one more variable regarding waistband measurement common to each of the four measurement classification. That is the effect on waist measurement length caused from breathing, both inhaling and exhaling.

This invention is directed at the problem of allowing a garment waistband to function incorporating the best of all conditions. One that allows the garment waistband to be fitted to the larger waist measurement length requirement. At the same time when one of the smaller waistband measurements are applicable the belt loops are secured inside the waistband in a manner that allows the upper portion of the belt loop to move inward without pulling in the waistband of the garment. The waistband does not gather and is free to retain a form fitted appearance.

In other invention applications where garment waistband measurements are fitted to meet one of the smaller waist measurement conditions the garment is tight when the larger waist measurement requirement exits. This not only renders the garment less confortable but even has long range detrimental health affects. A tight waistband measurement to an individual sitting for long periods of time tends to reduce the volume level of breathing and thereby reduces the oxygen intake in the lungs. This subsequently reduces the level of an individuals efficiency and generates the tired and draggy feeling. Conversely a garment waistband fitted to the larger waist measurement length will gather the waistband, whether belted from either outside or inside the garment with loops secured both at the top and at the bottom and the garment fitted to the larger waistband requirement. This improvement overcomes this objection.

By the use of belt loops placed on the inside of the garment and each loop secured only at the bottom the belt is free to pull inward at the top, reducing the waist length, without pulling in the waistband of the garment. A movement of the upper portion of the belt loop inward one-eighth of an inch allows the waistband belt securing the waistband to reduce by three-fourth of an inch while still maintaining the garment overall appearance of form fitting and simultaneously securing the garment to the occupant. It can readily be seen that a variation of the inward movement of the free upper end of the inside belt loop allows for a considerable waistband fitting variation. In essence there is a built in waist measurement change of the occupant without a waistband change requirement for the garment thereby making the garment considerably more wearably pleasing and healthful to the occupant.

By the use of an adjustable elastic belt supporting the garment waist using inside loops secured from the lower waist band each one-eighth inch increase in the radius dimension of the garment waist allows for over a three quarter inch increase in waist band circumference. Yet there is little to no noticable difference in the garment fit appearance and the garment is held up at all times. In other situations there are individuals that have a larger waist measurement than hip line measurement. This incorporates a very different set of circumstances in fitting pants and keeping them fitted in the proper place. This invention also addresses this situation and resolves the problem in a manner to keep individual grooming attractive and comfortable.

SUMMARY OF THE INVENTION

An inside waistband belt loop arrangement that allows for a body waist expansion permitting the waistband of a garment to be fitted to an individual's largest waist measurement, which will be in a seated position, yet when standing and the waist measurement of the individual is reduced the free floating upper ends of the belt loops are free to move inward and with the inside mounted belt secures the garment to the individual's waist without pulling in or gathering the garment waistband.

DESCRIPTION OF THE PREFERRED EMBODIMENTS

Figure 1:
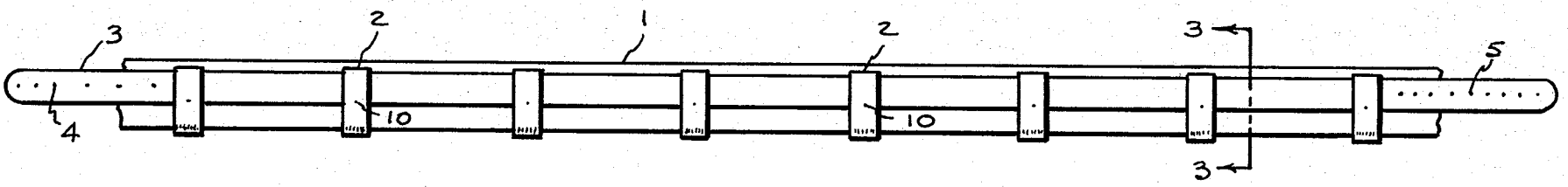
FIG. 1 shows an inside flat pattern arrangement of a garment waist band using an inside belt and belt loop.
Figure 2:
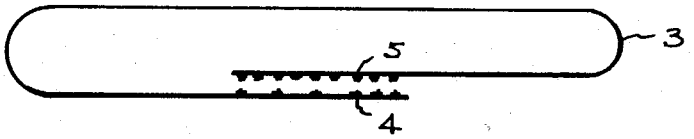
FIG. 2 shows the top view of an adjustable elastic belt with fasteners.
Figure 3:
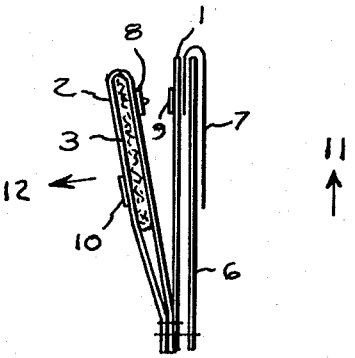
FIG. 3 whows a cross section view of garment waistband, belt and belt loops.

This invention incorporates the use of belt loops attached at the bottom and on the inside of the pants waistband. FIG. 1 shows a flat pattern view of the inside of the pants waistband and a universal elastic belt strung through them. FIG. 3 shows a make up of a cross section through the installation. Reference 11 is up and reference 12 is inside. Here 6 and 7 are shown as part of the garment waistband, 6 inner filler strip, 7 outer waistband. Belt loops 2 are attached to item 1 inside waistband 7 which at final assembly incorporates as part of the completed waistband including 6 and 7. An elastic belt 3 is installed through the belt loops 2 and 2 being attached at the bottom of the waist band is free to pull snugly against the body without pulling in or gathering of the outside pant waistband. This allows the garment to be fitted to a maximum waist measurement condition of the wearer at the same time the inside belt snugly fits around the body and holds up the garment from the bottom of the band. Without this in a standing position the garment waistband would appear loose. If fitted to the standing position waist measurement, when sitting, the garment would be uncomfortably tight. Using an outside belt arrangement when the garment if fitted loose and the belt is tightened in the standing position pants must gather at the waistband.

Figure 4:
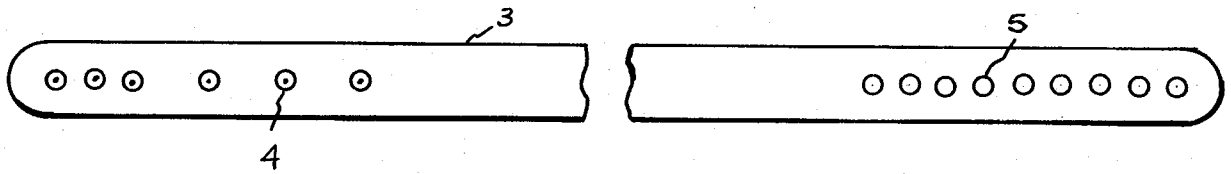
FIG. 4 shows a flat pattern elastic belt and fasteners.

The universal inside elastic belt 3, shown in FIG. 4, is attached at the ends by mating fasteners 4 and 5. It is made to accommodate a wide range of waist measurement sizes and need not be customized to each individual. Since the elastic belt grips from the inside it also serves to hold the shirt or inside blouse within the garment much better.

Additional features are incorporated into the design. Matching fasteners and 8 and 9 are added at each belt loop location and coordinated location on the inside waistband as shown in FIG. 3. Normally they are not fastened when wearing the garment. It may be desirable where the garment waistband is too much larger than the requirement of the inside belt and in certain posture configurations one or more of the loop fasteners may be fastened in to pull that portion of the garment waistband closer to the body. Another fasterner 10 is installed midpoint in each belt loop common to body as shown in FIG. 3. This allows for a flexible attaching point in the upper garment, a shirt or blouse, fitted to an individual whose waist measurement is greater than hip line measurement and the supporting of the garment in a well tailored position is difficult. An attachment in the center, up and down, on the inside belt loops afford a much greater flexibility than if the attachment was made directly to the inside surface of the waistband. The attachment combination gives a comfortable union suit feeling and at the same time the individual looks well groomed and fully put together at all times.

The inside belt configuration may be used on pants or shirts using outside belt loops or no loops at all. Where outside loops are used the outside belt in this case is only decoration.

I claim:

1. An improved garment waistband secured to the upper portion of a wearing apparel body garment of the type having a waistband, said waistband having inner and outer surfaces, a plurality of belt loops secured to the inner surface of said waistband at their lower ends only and at a distance from the upper margin of the waistband by a least the length of the loops including separable fastening means between said loop and said waistband.

2. An improvement garment waistband as recited in claim 1, in which the said belt loop includes:

(a) a fastener fixed to the surface common to the said inner waistband; and (b) a fastener fixed to the surface common to the body side for attaching to a body garment.

* * * * *